US005437063A

United States Patent [19]

Cotham

[11] Patent Number: 5,437,063

[45] Date of Patent: Aug. 1, 1995

[54] AUTOMATIC TOILET SEAT LIFTING APPARATUS

[76] Inventor: Charles E. Cotham, 1224 E. Jean St., Tampa, Fla. 33604

[21] Appl. No.: 266,477

[22] Filed: Jun. 27, 1994

[51] Int. Cl.[6] ..... A47K 13/10

[52] U.S. Cl. ..... 4/241; 4/246.1

[58] Field of Search ..... 4/241, 246.1, 248, 250, 4/246.2, 246.3, 246.4, 246.5, 253

[56] References Cited

U.S. PATENT DOCUMENTS

| | | | |
|---|---|---|---|
| 158,677 | 1/1875 | Clark | 4/241 X |
| 1,079,732 | 11/1913 | Waltensperger | 4/241 |
| 2,074,318 | 3/1937 | Bachmann | 4/241 |
| 2,632,896 | 3/1953 | Morikawa | 4/241 X |
| 4,491,989 | 1/1985 | McGrail | 4/246.1 |
| 4,912,783 | 4/1990 | Shafer | 4/250 X |

FOREIGN PATENT DOCUMENTS

| | | | |
|---|---|---|---|
| 0690895 | 9/1930 | France | 4/241 |
| 2264330 | 8/1993 | United Kingdom | 4/246.1 |

*Primary Examiner*—Robert M. Fetsuga

[57] ABSTRACT

A automatic toilet seat apparatus for raising a toilet seat to an upward position until the seat is need again. Having the toilet seat in a upward position helps to keep the top surface of the toilet seat from getting contaminated. In this particular embodiment, a lever arm, a counter weight, a pivot rod, and snap locking means are provided for raising a toilet seat. When the seat is manually lowered, the snap locking means secures the seat in the lowered position. When the toilet handle is pulled to flush the toilet, a cable is engaged releasing the snap locking means. The seat automatically raises to the upward position via a counter weight and lever arm.

2 Claims, 3 Drawing Sheets

AUTOMATIC TOILET SEAT LIFTING APPARATUS

BACKGROUND OF INVENTION

This invention relates to a device used in public restrooms for purposes of sanitation. More specifically, this invention automatically lifts the toilet seat each time the toilet is flushed. Having the seat in an upward position helps prevent contamination of the top surface of the toilet seat during stand up use. Only when the seat is needed, the user pulls down the seat and locks it in that position, via a snap locking means. When the user is finished and flushes the toilet, the flush handle releases the seat, and as the seat is counterweighted, the seat automatically lifts back to the upward position, and stays in this raised position during stand up use, and until it is required to use the seat again.

It has been customary to allow the user of the toilet to raise, or lower, the seat, as required, however, experience in rest rooms has proven that the users are very careless in the use of the toilet, and use the toilet in the stand up position, while failing to raise the seat, thereby creating a very unhealthful situation, and causing the next user of the toilet to improvise in the cleaning of the toilet seat, before using it.

Several approaches have been provided for correcting this problem, and, in the art of Zamoyski, in U.S. Pat. No. 5,237,708, "A foot actuated toilet seat lifting, anti-slamming, and reseating device that functions exceptionally well over a wide range of user foot pressure variations or abruptness. The base member is substantially a lever pivotally attached to a fulcrum. The lever has a resilient material attached at the foot receiving end, an adjustable lifting rod pivotally attached at the opposite end, and a pneumatic device adjustably and pivotally attachable in between. Both the rod and pneumatic device extend upward and are pivotally attached to the toilet seat by a bracket. The pneumatic device does not provide resistance as the seat is lifted, and it dampens, then stops the seat at the desired lift position, thereby preventing slamming of the seat, and then provides a gentle return of the seat without slamming even if the users foot is abruptly removed. The resilient material on the foot receiving end feels good as well as aiding damping at lift climax, and aiding in return of the seat.

While this art has its advantages, it fails to take into consideration the state of mind of the user, and if the user does not actuate the foot control, the stand up user will still contaminate the seat during use.

Another approach is taught in the art of Won, in U.S. Pat. No. 4,975,988 wherein the abstract reads as follows, "It is desirable to be able to lift, lower and lock a toilet seat assembly in position without any hands-on interaction with the toilet seat assembly. In order to accomplish this objective the invention incorporates a selection of devices having additional mechanical advantages when pivoting the seat assembly. In one preferred embodiment of the invention, a cable-operated foot lever is used in combination with a crank portion on the hinge of the toilet seat. In another preferred embodiment of the invention, a system of planetary gears is used in the lever and/or the hinge assembly. A disadvantage in using this approach is that a dependence on the user is still present, and, experience has shown that these users do not think in terms of cleanliness, only expediency, and they refuse, or disregard the safety devices, and the contamination problem still is present.

Still another approach is taught in the art of Mercier, in U.S. Pat. No. 5,279,000, wherein "An automatic toilet seat lowering hinge assembly for automatically lowering a toilet seat from a raised position to a lower position above the toilet seat, includes a housing having a chamber through which a shaft is disposed therein. The shaft is releasibly attached to the toilet seat. The housing has a baffle extending from the inner-surface of the housing to the surface of the shaft and a descent paddle extends from the shaft outwardly toward the inner surface of the housing to partition the chamber into two compartments. A vent controls the transfer of fluid between the partitioned chamber compartments in order that the toilet seat pivots from the raised position to the lower position in a predetermined amount of time. Although this art would protect the toilet seat from slamming down, when a person wants to use it in the setting position, it does not provide means for raising the seat, when the user is finished, thereby allowing for stand up use, and partially eliminating the contamination problem, as does the invention of the Applicant.

SUMMARY OF THE INVENTION

Accordingly, it is an object of this invention to keep a toilet seat in the upward position, after use, and to provide for immediate stand up use at all times.

Another object of this invention is prevent the top side of the toilet seat from becoming contaminated by the stand up user.

Still another object of this invention is automatically lift the toilet seat every time the toilet is flushed, except when some one is sitting on the seat.

Still yet another object of this invention is to lock the toilet seat in the down position, when in use, and to remain in this position until the toilet is flushed.

A further object of this invention is to provide a counter weight, heavier than the weight of the toilet seat, which is able to automatically lift the toilet seat when the toilet is flushed.

Still a further object of this invention is to provide a lever arm affixed beneath the toilet seat that will allow the transfer of torque from the counter weight to the toilet seat, to lift the toilet seat to the raised position, when the toilet is flushed.

Another object of this invention is to provide a control cable from the toilet flush handle mechanism, to a spring loaded locking mechanism for the counterweight, allowing the cable to unlock or release the locking mechanism each time the toilet handle is moved to flush the toilet.

Still another object of this invention is to provide a locking mechanism that will allow the toilet seat to snap lock in place when pulled to the down position.

Still yet another object of this invention is to provide a pivot joint that will provide an axis of rotation to allow the lever arm beneath the seat and the counter weight to rotate.

In carrying out this invention in the illustrative embodiment thereof, a new mounting assembly is attached to the lower surface of a toilet seat, and this assembly is fitted with a counter weight, and the counterweight is heavier than the toilet seat, and will automatically raise the seat, when the toilet is flushed, providing a heavier weight then the toilet seat, such as a person, is not setting on the seat. Now, when in this lowered position, the assembly is locked in this position by a detent arrangement, and will stay in the lowered position until the detent is overpowered.

Now, when the person is finished using the toilet, and flushes the toilet, a cable is attached from the flushing handle to the detent arrangement, and the detent is released, thereby allowing the counter weight to raise the seat, and the seat will remain raised for those using the toilet in a stand up position. When a user desires to sit on the toilet, they merely lower the seat to the locking position of the detent.

Conveniently, the user may approach the toilet, and, if they are going to use the toilet in a stand up position, the seat remains raised, thusly eliminating a very serious contamination problem. However, if the person wants to sit on the seat, they lower the seat, and use the toilet, knowing that the seat is clean, and, when they are finished, they flush the toilet, thereby actuating the cable, and releasing the detent, and the seat will automatically raise, and stay in that position.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1, sheet 2 contains FIG. 2, and sheet three contains FIG. 3.

DESCRIPTION OF THE PREFERRED EMBODIMENTS

Figure 1:
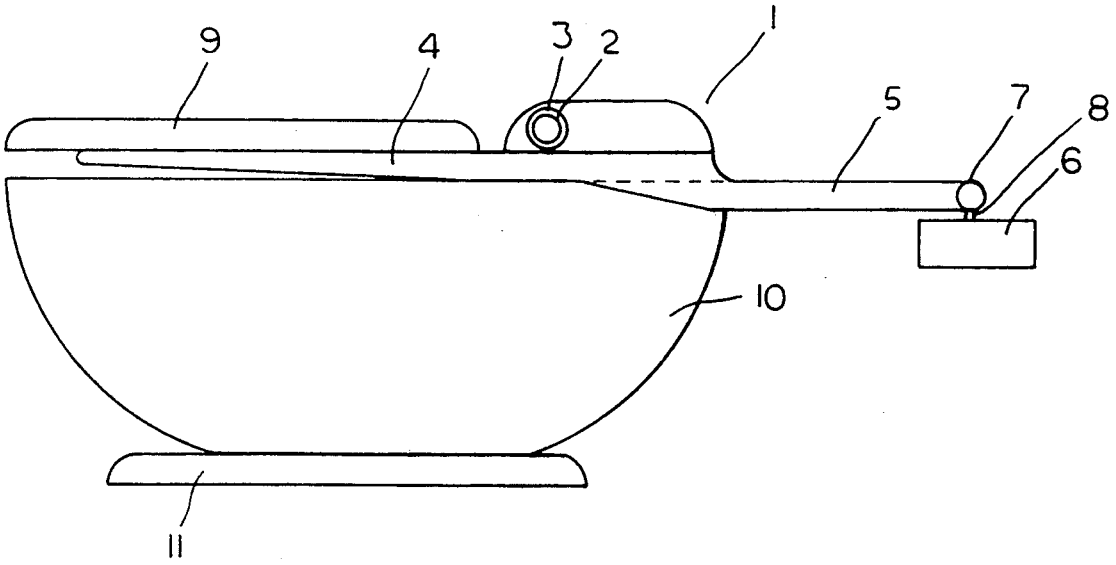
FIG. 1 is a side view of the invention, showing the counterweight, the detent, and the detent release cable.

Referring now to FIG. 1, an automatic toilet seat lifting apparatus referred to generally by the reference numeral 1 is made of a pivot rod 2 to support seat lever arm 4 and weight lever arm 5. Removeably affixed to seat lever arm 4 is toilet seat 9. Affixed to the end of weight lever arm 5 is a rotatable hinge 7 whereby a counter weight 6 is suspended via rod 8. Securing seat lever arm 4 and weight lever arm 5 to pivot rod 2 is a retainer clip 3. Also shown in FIG. 1 is the toilet bowl 10 supported by a base 11.

Figure 2:
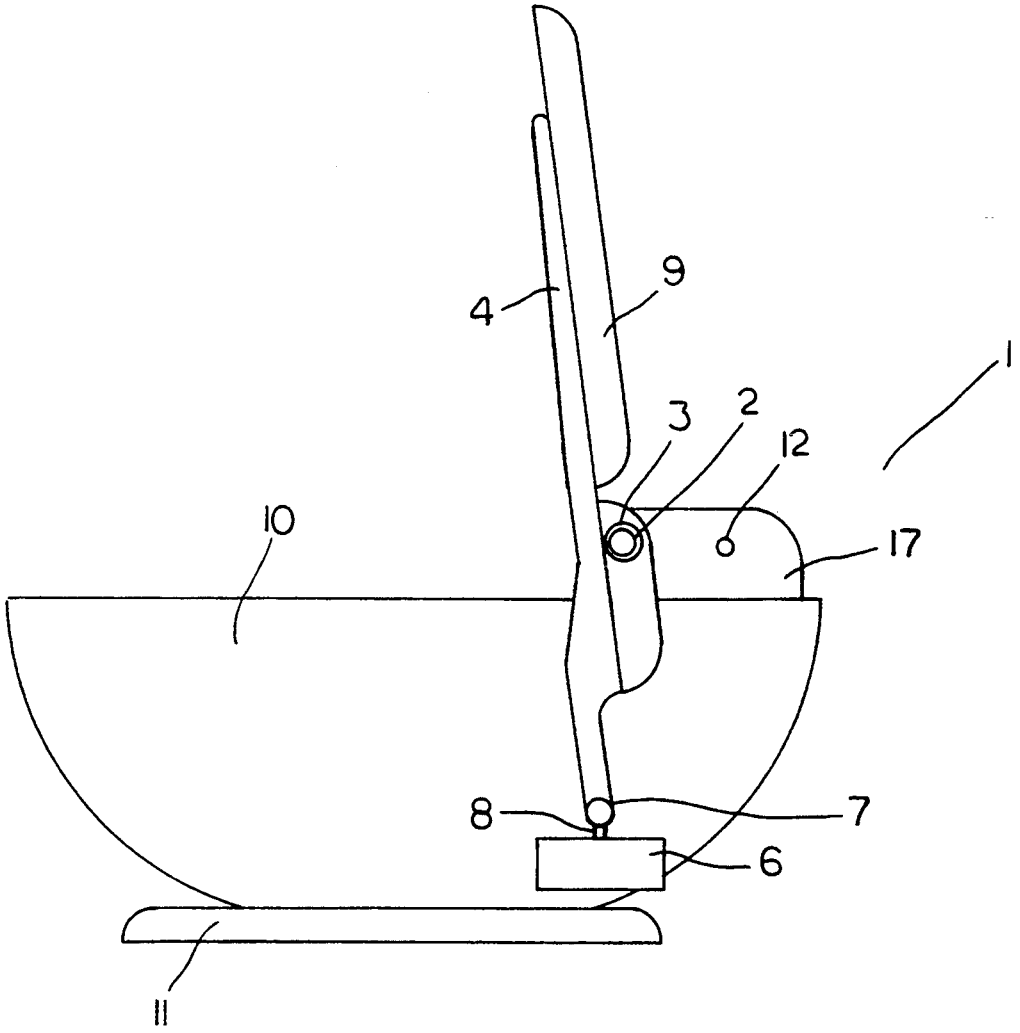
FIG. 2 is a side view of the invention, showing the counterweight and the toilet seat in the raised position.

Referring now to FIG. 2, with the toilet seat in an open position, we see the automatic toilet seat lifting apparatus 1 is made of a pivot rod 2 to support seat lever arm 4 and weight lever arm 5. In the open position, the rounded head of a pin 12 is exposed through housing 17. Removeably affixed to seat lever arm 4 is toilet seat 9. Affixed to the end of weight lever arm 5 is a rotatable hinge 7 whereby a counter weight 6 is suspended via rod 8. Securing seat lever arm 4 and weight lever arm 5 to pivot rod 2 is a retainer clip 3. Additionally, FIG. 2 displays a toilet bowl 10 supported by a base 11.

Figure 3:
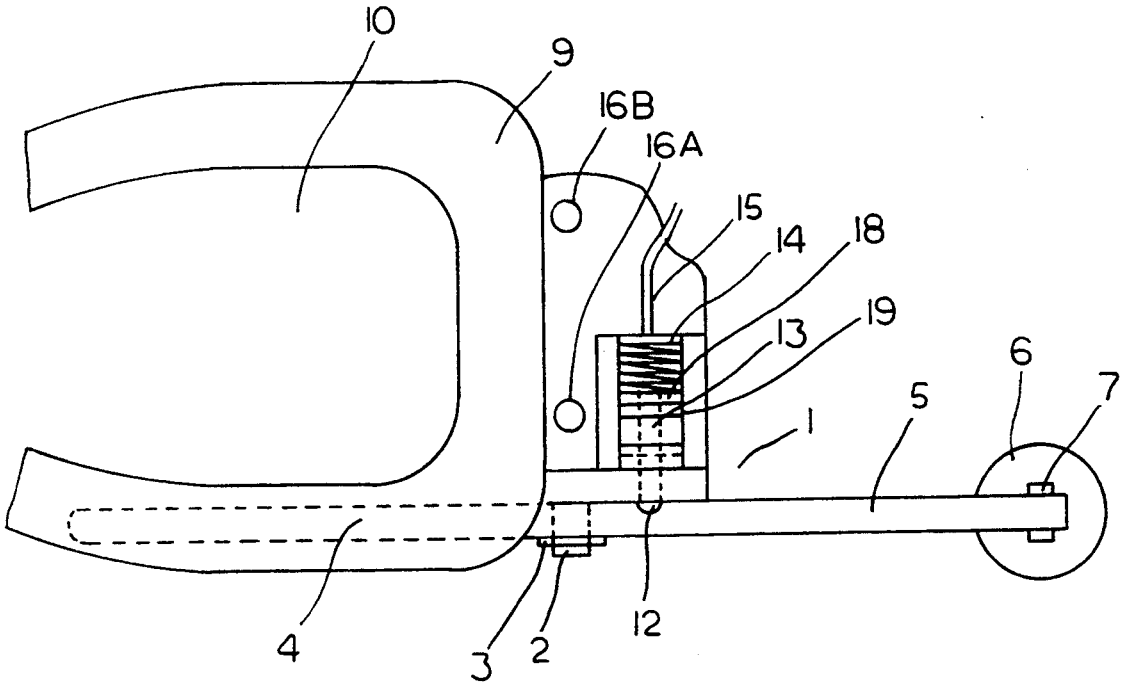
FIG. 3 is a top view of the invention, showing the counterweight and the toilet seat in the lowered position.

Referring now to FIG. 3, a top view of the automatic toilet seat lifting apparatus 1 is made of a pivot rod 2 to support seat lever arm 4 and weight lever arm 5. In the open position, the rounded head of a pin 12 is exposed through housing 17. Removeable affixed to seat lever arm 4 is toilet seat 9. Affixed to the end of weight lever arm 5 is a rotatable hinge 7 whereby a counter weight 6 is suspended. Securing seat lever arm 4 and weight lever arm 5 to pivot rod 2 is a retainer clip 3. Affixed to rounded head 12 is a rod 13 wherein a flat plate 18 is affixed at the opposite end. The rod 13 is able to slide through an opening in a wall 19 that is abutted against flat plate 18. The rounded rod head 12 is embedded a given distance into a cavity inside the weight lever arm 5, creating a detent arrangement, when the toilet seat is a fully lowered position. A spring 14 keeps flat plate 18 abutted against the wall 19. Affixed to the rod 13 is a cable 15 that pulls the rod 13 and flat plate 18 back a given distance enough to remove the rounded rod head from the cavity of the weighted lever arm 5, thereby releasing rod 13 from the detent. Affixing the toilet seat 9 to the toilet bowl 10 are brackets 16A and 16B.

Accordingly, a very unique, attractive apparatus is provided for automatically lifting a toilet seat each time the toilet is flushed, whereby the toilet seat is kept in a raised, or open position, for those persons using the toilet in a stand up position, yet is easily lowered for those persons desiring to sit on the seat, thereby eliminating a very serious contamination problem with toilets.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. An automatic toilet seat lifting apparatus for lifting a pivotal toilet seat from a downward to an upward position when a toilet flush handle is actuated, the automatic toilet seat lifting apparatus comprising:

(a) an elongated seat lever arm adapted to be affixed at one end portion thereof to said toilet seat; and, (b) a housing assembly including pivot means for rotatably affixing said seat lever arm at an intermediate portion thereof to said housing assembly; and, (c) a counter weight affixed to an opposite end portion of said lever arm via a rotatable hinge, said counter weight having a given weight; and, (d) snap locking means mounted to said housing assembly for locking said toilet seat in said downward position, said snap locking means comprising:

(a) a rod having a given length and diameter, said rod having a rounded head at one end engaged with a cavity in said lever arm; and, (b) a flat plate affixed to said rod at an end opposite said rounded head end, said flat plate being affixed to said rod in a substantially perpendicular fashion relative to the longitudinal rod axis; and, (c) a spring engaging said flat plate; and, (d) cable means for affixing said rod to said toilet handle, whereby when said toilet handle is actuated, said cable means releases said rounded head from said cavity thereby allowing said toilet seat to be raised automatically.

2. An automatic toilet seat lifting apparatus as set forth in claim 1 wherein when said toilet handle is actuated, said cable means is pulled releasing said rounded rod head from said cavity thereby releasing said toilet seat.

* * * * *